United States Patent [19]

Poole et al.

[11] Patent Number: 4,960,459

[45] **Date of Patent: * Oct. 2, 1990**

[54] METHOD FOR SURFACE ACTIVATION OF WATER ATOMIZED POWDERS BY PICKLING

[75] Inventors: Jon M. Poole; Lindy J. Curtis, both of Huntington, W. Va.

[73] Assignee: Inco Alloys International, Inc., Huntington, W. Va.

[ * ] Notice: The portion of the term of this patent subsequent to Apr. 4, 2006 has been disclaimed.

[21] Appl. No.: 253,841

[22] Filed: Sep. 19, 1988

Related U.S. Application Data

[62] Division of Ser. No. 71,654, Jul. 9, 1987, Pat. No. 4,818,482.

[51] Int. Cl.[5] ..... C23G 1/02

[52] U.S. Cl. ..... 419/63; 134/3; 134/27; 134/28; 134/29; 134/41; 419/30

[58] Field of Search ..... 134/3, 27, 28, 29, 41; 75/0.5 A, 0.5 C, 96, 119; 419/30

[56] References Cited

U.S. PATENT DOCUMENTS

| | | | |
|---|---|---|---|
| 3,764,295 | 10/1973 | Lindskog et al. | 75/0.5 C |
| 3,859,086 | 1/1975 | Church et al. | 75/211 |
| 4,084,964 | 4/1978 | Grant et al. | 75/0.5 C |
| 4,818,482 | 4/1989 | Poole et al. | 419/33 |

FOREIGN PATENT DOCUMENTS

| | | |
|---|---|---|
| 61-113702 | 5/1986 | Japan . |
| 62-023909 | 1/1987 | Japan . |
| 956147 | 9/1982 | U.S.S.R. . |
| 593904 | 10/1947 | United Kingdom . |
| 604379 | 7/1948 | United Kingdom . |
| 1602582 | 11/1981 | United Kingdom . |

OTHER PUBLICATIONS

Derwent WPI Acc. No. 83-710341/28, Jul. 1982.
Derwent WPI Acc. No. 86-179958/28, May 1986.
Derwent WPI Acc. No. 87-069679/10, Jan. 1987.

*Primary Examiner*—Olik Chaudhuri
*Assistant Examiner*—George Fourson
*Attorney, Agent, or Firm*—Francis J. Mulligan, Jr.; Edward A. Steen

[57] ABSTRACT

A method for pickling and consolidating water atomized metallic powders to reduce surface oxides. The technique includes introducing the powder into an acid bath—preferably nitric acid and hydrofluoric acid, rinsing the powder, introducing the powder into an alkaline bath, rinsing the powder and then consolidating the powder into a workpiece. Alternatively, the powder can be additionally introduced into a second acid bath and/or placed into a finishing boric acid bath before consolidation.

10 Claims, 2 Drawing Sheets

METHOD FOR SURFACE ACTIVATION OF WATER ATOMIZED POWDERS BY PICKLING

This is a divisional of co-pending application Ser. No. 07/071,654 filed on Jul. 9, 1987 now U.S. Pat. No. 4,818,482.

TECHNICAL FIELD

The instant invention relates to powder metallurgy ("P/M") techniques in general and, more particularly, to a method for producing a compactable, low oxygen, water atomized powder.

BACKGROUND ART

Superalloy powders are typically produced by inert atomization processes such as argon atomization, vacuum atomization, rotating electrode process and rotary disk atomization. Water atomization processes are not generally acceptable due to the formation of a heavy surface oxide produced by a chemical reaction of the form: $xMe+yH_2O=Me_xO_y+yH_2$. Reactive elements (Si, Al, Ti, Cr, Mn) are oxidized and are difficult to reduce in subsequent processing. Since oxides are detrimental to the product's mechanical properties, inert atomization processes (oxygen <200 ppm) are used.

Unfortunately, inert atomization processes produce spherical powders which are not satisfactory for standard die compaction processes. These powders require special consolidation practices such as HIP (Hot Isostalic Pressing), Cercon, CAP (consolidated at pressure), etc. which are rather expensive. Due to costs of gas atomization and consolidation, the use of powder metallurgy for superalloy production has been limited to aerospace applications where the expense is justified.

There is a need for a superalloy powder that can be die compacted using existing technology. Such a powder should have an irregular shape, small average particle size and low oxygen content (<200 ppm). Water atomization can produce the irregular powder, but the oxygen content is too large. If the oxides can be removed in a cost effective process, these powders would be commercially attractive. In the steel industry, some strides are being made to satisfy these requirements. Stainless steel powders (304L, 316L, 410 and 430 grades) containing chromium and/or manganese are available and are being used to lower the cost and improve the hardenability of a finished product. These powders are produced by water atomization under conditions that minimize the oxygen level (oxygen <1500 ppm). Some of these parameters are an inert purge of the atomization chamber, lower silicon heats, use of soft water (low calcium), and minimizing liquid turbulence during melting to reduce slag impurities. Further, during processing a high temperature sintering operation is used with careful control of dew point and carbon reduction to remove any oxides. In another related process (QMP), tool steels are made from water atomized powders by producing a high carbon heat. During the sintering operation a self generated CO—$CO_2$ atmosphere reduces the oxygen content.

The ultimate aim is to produce a low oxygen containing product or powder by removing the tenacious surface oxide from lower cost water atomized powders. One promising method for accomplishing this goal requires pickling the powder. Difficulties arise in optimizing the pickling procedure including the selection of the baths and their utilization.

Other researchers have demonstrated the favorable effects of pickling powders in various alloy systems. In U.S. Pat. No. 2,638,424 a process is disclosed for processing aluminum and magnesium powders to remove detrimental oxide and nitride films. The powders are treated with nitric acid in a continuous process. In U.S. Pat. No. 4,477,296, noble metal powders (Au, Pd, Ag, Pt and/or alloys) or base metal powders (Cu, Ni, Sn, Al, Sb, Ti, V, Cr, Mg, Fe, Co, Zn, Cd, Rh) are surface treated to remove undesirable oxides. The key application of this invention is in the manufacture of multilayer capacitors. The described invention consists of: (a) treating the surface with an aqueous solution of a reducing agent for the oxide; (b) washing the powders with an aqueous solution to a pH of 5.5–7.0 and (c) drying the powders.

In a related topic, U.S. Pat. No. 4,566,939 describes a method for removal of undesirable oxides from aluminum or titanium containing nickel-iron-base or nickel-base alloys prior to brazing or diffusion bonding. The workpiece is heat treated above 1800° F. (982° C.) to form an Al/Ti rich oxide. This oxide is removed using a strong alkaline solution and/or molten salt bath. It is reported that the alkaline solution is preferred over acid solutions for removing surface oxides because they do not etch or attack the base metal or remove the depleted Al/Ti layer beneath the surface oxide.

Another related area involves the application of a sintering activator during the pickling sequence. There are several patents pertaining to the use of boron as a sintering activator. U.S. Pat. No. 3,704,508 deals with the well known CAP process where boric acid is used as a sintering activator. U.S. Pat. No. 4,407,775 teaches the use of lithium tetraborate additions to powders as a sintering activator. U.S. Pat. No. 4,113,480 deals with injection molding using a boric acid-glycerin system for mold release and activated sintering. Lastly, assignee's U.S. Pat. No. 4,626,406 deals with the use of boron containing activators in P/M slurry extrusions.

SUMMARY OF THE INVENTION

Accordingly, there is provided a multi-bath pickling procedure including an acid bath and an alkaline bath with an optional final boric acid rinse. In brief, water atomized nickel-base, cobalt-base or iron-base powders are immersed after water atomization into an acid bath, rinse and alkaline bath or, if desired, an acid bath, rinse, alkaline bath, rinse, acid bath and rinse.

PREFERRED MODE FOR CARRYING OUT THE INVENTION

Figure 1:
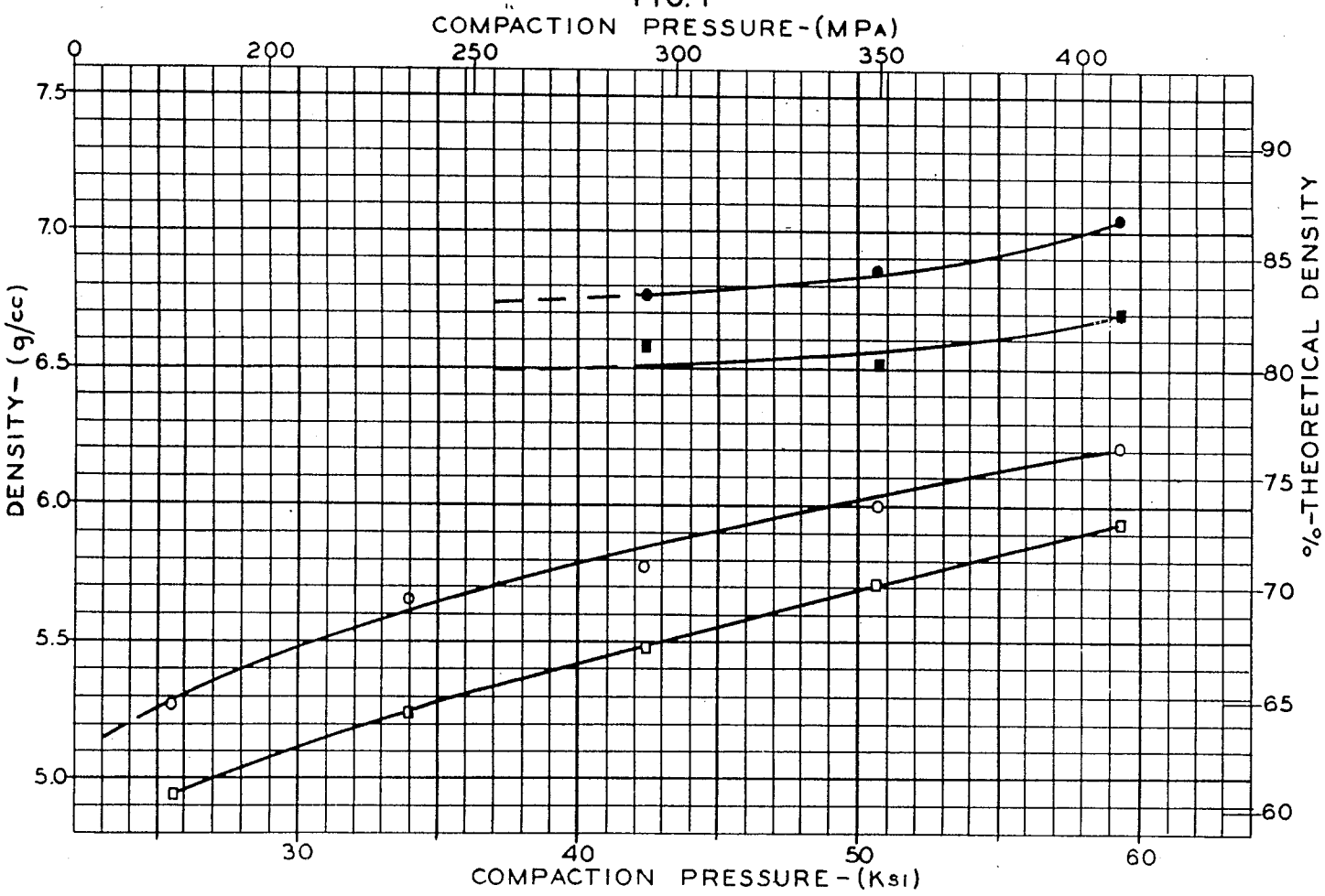
FIG. 1 is a graph depicting the effect of pickling on density v. compaction pressure.

Water atomized Inconel alloy 825 (Trademark of INCO Alloys Int.) lot 1 was used throughout this study. The chemistry of this lot along with some results on argon atomized powders (lots 2–4) for comparison purposes are given in TABLE 1. Note the high oxygen (3800 ppm) and nitrogen (800 ppm) content as compared to the argon atomized powders (oxygen <300 ppm, nitrogen <100 ppm). The average size of the water atomized powder is 50 μm and the argon atomized powder about 70–100 μm; although this will vary depending on the atomizing conditions.

TABLE 1

CHEMICAL ANALYSIS OF ALLOY 825 POWDERS

| Element | Lot 1 | Lot 2 | Lot 3 | Lot 4 |
|---|---|---|---|---|
| C | 0.046 | 0.010 | 0.020 | 0.008 |
| Mn | 0.015 | 0.01 | 0.47 | 0.30 |
| Fe | 29.29 | 29.51 | 37.64 | 39.20 |
| S | 0.0017 | 0.002 | 0.002 | 0.003 |
| Si | 0.07 | 0.05 | 0.05 | 0.06 |
| Cu | 1.73 | 1.45 | 2.32 | 1.90 |
| Ni | 42.05 | 42.20 | 27.81 | 26.0 |
| Cr | 22.41 | 22.73 | 26.15 | 27.5 |
| Al | 0.0046 | 0.02 | 0.09 | 0.10 |
| Ti | 0.40 | 0.72 | 1.01 | 0.99 |
| Mo | 3.08 | 3.05 | 3.98 | 4.03 |
| Cb + Ta | 0.02 | 0.0! | 0.03 | 0.03 |
| 0 | 0.38 | 0.018 | 0.013 | 0.030 |
| N | 0.08 | 0.003 | 0.006 | 0.010 |

NOTES:
(1) Lot 1 is water atomized powder, others are argon atomized powders included for comparison.
(2) Lots 3 and 4 are out-of-definition for Inconel alloy 825 chemistry.

Pickle bath compositions, temperatures and holding times with the general pickle procedures are given in TABLE 2.

TABLE 2

PICKLE BATH COMPOSITIONS AND PICKLE PROCEDURES

| Bath | Composition | Temperature (°F.) | Temperature (°C.) | Time (hr.) |
|---|---|---|---|---|
| A | 20% $HNO_3$ - 2% HF - Bal $H_2O$ | 160–180 | 71–82 | 0.5 |
| B | 10% HCl - Bal $H_2O$ | Room Temperature | | 0.5 |
| C | 5% $NH_4OH$ - Bal $H_2O$ | 180 | 82 | 0.5 |
| D | 5% $H_3BO_4$ - Bal $H_2O$ | 180 | 82 | 0.5 or 1.0 |
| E | 5% $KMNO_4$ 15% NaOH - Bal $H_2O$ | 180 | 82 | 0.5 or 1.0 |
| F | $H_2O$ | Room Temperature | | Rinse |

| Pickle Procedure No. | Process | Pickle Procedure No. | Process |
|---|---|---|---|
| 1 | A-F-B-F | 5 | A-F-E (0.5 hr)-F-A-F |
| 2 | A-F-C-F | 6 | A-F-E (1.0 hr)-F-A-F |
| 3 | A-F-D (0.5 hr) | 7 | A-F-E (0.5 hr)-F-A-F-D |
| 4 | A-F-D (1.0 hr) | | |

NOTES:
(1) All chemicals are lab reagent grade quality.
(2) Water used is tap water.
(3) Liquid measurements are in vol. % ($HNO_3$—HF, HCl and $NH_4OH$).
(4) Solid measurements are in wt. % ($H_3BO_4$, $KMNO_4$—NaOH)
(5) Times refer to time-at-temperature.

The pickling process started with about 150 grams of powder which was added to 500 ml of pickling solution in a Teflon® container. The solution was heated until the bath reached the proper temperature. The temperature was maintained for some predetermined period of time, then water was added to cool the solution and stop the reaction. This procedure was repeated for the additional solutions using water rinsed powders from the prior bath. The final water rinse produced a final pH of about 4–6; the excess water was drained and the powder was dried at about 212° F. (100° C.) in air. The powders after pickling are usually a light grey in color as opposed to the brownish color of the as-atomized powders. Powders receiving the most processing generally have a brighter metallic appearance than the other powders.

Five pounds (2.3 kg) of powder for the direct rolling to strip was treated using procedure 6 using 500 grams of powder to 1000 ml of solution. Due to the reduced acid-powder ratio and longer drying times, it is expected that this powder would be of lower quality relative to the smaller batch runs. A larger batch operation is necessary to do a proper job.

The pickled and non-pickled powders were uniaxially compacted at various pressures to an approximate 1.25 inch (32 mm) diameter by 0.2 inch (5 mm) to 0.5 inch (1.3 mm) height compact. Unless otherwise noted, 0.5 weight percent of a GLYCO® PM 100 lubricant was added to the powders to enhance compaction. One set of compacts (TABLE 3) was sintered in a laboratory muffle furnace at 2200° F. (1204° C.)/1 hr hydrogen atmosphere and muffle cooled. Due to furnace problems the actual treatment was 1800° F. (982° C.)/48 hrs plus 2200° F. (1204° C.)/1 hr under hydrogen atmosphere. These pieces were re-sintered in an electric furnace individually at 2400° F. (1316° C.)/4 hrs hydrogen muffle cooled. Pieces were gradually placed in the hot zone of the furnace (at temperature), kept at temperature for four hours, then removed into the muffle for cooling. The pieces did not cool to room temperature in the muffle after four hours and were subsequently water quenched on removal from the furnace. A second series of compacts were sintered in the electric furnace between 2200° F. (1204° C.) and 2400° F. (1316° C.) (TABLE 4) using this same procedure.

TABLE 3

EFFECT OF COMPACTION PRESSURE AND SINTERING TEMPERATURE ON THE DENSITY OF ALLOY 825 POWDER

| Pickle No. | Compaction Pressure (ksi) | Compaction Pressure (MPa) | Green (g/cc) | 2200° F. (1204° C.)/1h $H_2$ (g/cc) | 2400° F. (1316° C.)/4h $H_2$ (g/cc) | Oxygen (%) | Nitrogen (%) |
|---|---|---|---|---|---|---|---|
| None | 59.2 | 408.2 | 5.93 | 5.94 | 6.70 | 0.143 | 0.060 |
| | 50.7 | 349.6 | 5.70 | 5..78 | 6.53 | — | — |
| | 42.3 | 291.7 | 5.49 | 5.57 | 6.58 | — | — |
| | 33.8 | 233.0 | 5.23 | 5.32 | — | — | — |
| | 25.4 | 175.1 | 4.95 | 5.02 | — | — | — |
| 6 | 59.2 | 408.2 | 6.20 | 6.16 | 7.04 | 0.044 | 0.045 |
| | 50.7 | 349.6 | 6.00 | 5.97 | 6.86 | — | — |
| | 42.3 | 291.7 | 5.78 | 5.74 | 6.78 | — | — |

TABLE 3-continued

EFFECT OF COMPACTION PRESSURE AND SINTERING TEMPERATURE ON THE DENSITY OF ALLOY 825 POWDER

| Pickle No. | Compaction Pressure (ksi) | (MPa) | Green (g/cc) | 2200° F. (1204° C.)/1h $H_2$ (g/cc) | 2400° F. (1316° C.)/4h $H_2$ (g/cc) | Oxygen (%) | Nitrogen (%) |
|---|---|---|---|---|---|---|---|
| | 33.8 | 233.0 | 5.54 | 5.52 | — | — | — |
| | 25.4 | 175.1 | 5.28 | 5.26 | — | — | — |
| 5 | 59.2 | 408.2 | 6.17 | 6.18 | 6.86 | 0.035 | 0.033 |
| 4 | 59.2 | 408.2 | 6.01 | 5.79 | 7.41 | 0.077 | 0.075 |
| 3 | 59.2 | 408.2 | 6.06 | 5.93 | 7.20 | 0.096 | 0.084 |
| 2 | 59.2 | 408.2 | 6.00 | 5.90 | 6.72 | 0.101 | 0.032 |
| 1 | 59.2 | 408.2 | 6.00 | 5.88 | 6.83 | 0.129 | 0.031 |
| 7 | 59.2 | 408.2 | 5.98 | — | 7.78 | — | — |

NOTES:
(1) Powder compacted with 0.5 weight % Blyco PM100 lubricant (except 7).
(2) Reported oxygen levels are high due to oxidation on removal from furnace.
(3) Data for 7 from TABLE 4.
(4) Pickle procedures are given in TABLE 2.
(5) See FIG. 1.

TABLE 4

EFFECT OF SINTERING TEMPERATURE ON THE DENSITY OF COMPACTED, PICKLED ALLOY 825 POWDER

| Pickle No. | Compaction Pressure (ksi) | (MPa) | Heat Treatment (Hydrogen with MC) | Green (g/cc) | Sintered (g/cc) | Oxygen (%) | Nitrogen (%) |
|---|---|---|---|---|---|---|---|
| 6 | 59.2 | 408.2 | 2220° F. (1204° C.)/4 hr | 6.12 | 6.34 | 0.075 | 0.010 |
| | | | 2250° F. (1232° C.)/4 hr | 6.12 | 6.38** | — | — |
| | | | 2300° F. (1260° C.)/4 hr | 6.13 | 6.73 | 0.075 | 0.019 |
| | | | 2350° F. (1288° C.)/4 hr | 6.09 | 6.77 | 0.069 | 0.006 |
| | | | 2400° F. (1316° C.)/4 hr | 6.08 | 6.93 | 0.037 | 0.038 |
| 7 | 59.2 | 408.2 | 2200° F. (1204° C.)/4 hr | 5.98 | 6.27* | 0.093 | 0.023 |
| | | | 2250° F. (1232° C.)/4 hr | 5.98 | 6.52* | 0.088 | 0.016 |
| | | | 2300° F. (1260° C.)/4 hr | 6.00 | 6.51* | 0.193 | 0.005 |
| | | | 2350° F. (1288° C.)/4 hr | 5.92 | 7.81 | 0.119 | 0.032 |
| | | | 2400° F. (1316° C.)/4 hr | 5.98 | 7.78* | — | — |

NOTES:
(1) *Denotes slight surface oxidation visible.
(2) **Denotes extensive surfsce oxidation visible.
(3) No compaction lubricant was added to either 6 or 7.
(4) See FIG. 2.

Non-pickled and pickled alloy 825 powders were also direct rolled to strip. The processing was as follows:

1. Direct roll several 0.035 inch (0.88 mm) thick strips;
2. Sinter 2200° F. (1204° C.)/4 hr in hydrogen, muffle cool in a muffle furnace;
3. Cold roll about 27% reduction for the pickled powder strip (range from 22% to 35%) and about 23% reduction for non-pickled strip (range 16% to 27.5%);
4. Anneal 2100° F. (1149° C.)/1 hr in hydrogen, muffle cool in a muffle furnace;
5. Cold roll about 30% for the pickled powder strip (range 26% to 34.5%), about 28% for the non-pickled strip (range 19% to 33%);
6. Anneal 2100° F. (1149° C.)/1 hr in hydrogen, muffle cool in a muffle furnace;
7. Cold roll about 30% to 0.014 inch (0.36 mm) thickness; and
8. Anneal 1750° F. (954° C.)/1 hr in hydrogen, muffle cool in a muffle furnace.

In general, the pickled powders were far superior to the non-pickled powders relative to percent yield, compactability, edge retention, resisting edge cracking, and the ability to withstand more cold reduction without cracking. A considerable amount of the non-pickled powder strip was removed due to edge cracking and center cracking. The pickled powder strip showed no center surface cracks and only minor edge cracks.

The development of the strip was monitored by bend tests during processing. The direct rolled strip was flexible, but could not be bent or easily broken. The sintered strip could withstand only a minor bend, but as the strip received additional processing the bend test improved. After step 6, the material could withstand an OT bend without breaking, although some cracking was observed in the bend (non-pickled material was worse). After step 8, the pickled powder strip did not show any cracks on an OT bend, whereas the non-pickled strip still showed cracking. Close examination of the strip surface showed that the non-pickled strip had light surface cracks, the pickled powder strip had no surface cracks.

FIG. 1 plots density v. compaction pressure of lot 1 under several circumstances. 0 represents procedure 6 as pressed. • represents procedure 6 at 2400° F. (1316° C.) in hydrogen. □ represents no pickling procedure. ■ represents no pickling at 2400° F. (1316° C.) in hydrogen. The 0.5% lubricant was added to the powder to facilitate processing.

Figure 2:
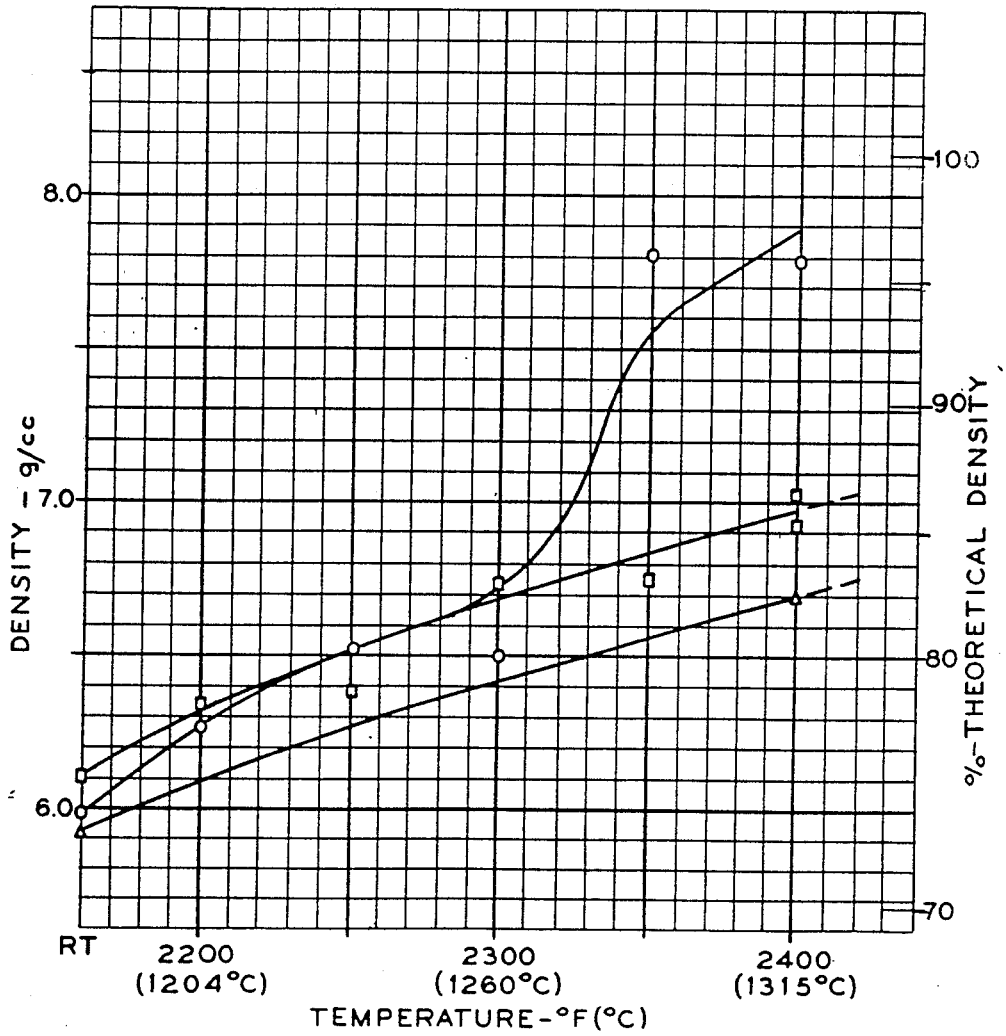
FIG. 2 is a graph depicting sintering curves with respect to density and temperature.

FIG. 2 is a sintering curve for lot 1. The powder was consolidated at 59.2 ksi (480 MPa), sintered at the indicated temperature for four hours under hydrogen and then muffle cooled. Δ represents no pickling (with 0.5% lubricant added to assist consolidation). □ represents procedure 6. 0 represents procedure 7 (boric acid).

Evaluation of the compacted samples consisted of density determination, chemical analysis (oxygen, nitrogen, carbon and sulfur), and metallographic analysis (TABLES 3–4, FIGS. 1 and 2). Evaluation of the direct rolled strip involved room temperature tensile tests, chemical analysis (oxygen, nitrogen, carbon and sulfur) and metallographic analysis (TABLE 5). Density measurement was based on weight and piece dimensions. This method is not precise, but there is no other acceptable procedure for very porous materials. Estimated error on density calculations was 2%.

TABLE 5

ROOM TEMPERATURE TENSILE RESULTS ON COLD ROLLED, ANNEALED ALLOY 825 STRIP PRODUCED BY DIRECT ROLLING POWDER

| Pickle Procedure | 0.2% Offset Yield Strength (ksi) | 0.2% Offset Yield Strength (MPa) | Tensile Strength (ksi) | Tensile Strength (MPa) | Elongation (%) | Oxygen (%) | Nitrogen (%) |
|---|---|---|---|---|---|---|---|
| None | 66.6 | 459.2 | 100.5 | 692.9 | 10.0 | 0.05 | 0.21 |
| | 66.4 | 457.2 | 100.5 | 692.9 | 24.0 | — | — |
| 6 | 66.1 | 455.7 | 113.9 | 785.3 | 30.0 | 0.009 | 0.15 |
| | — | — | 113.8 | 784.6 | 33.0 | — | — |

NOTES:
(1) The 0.014 inch (.36 mm) thick sheet was annealed at 1750° F. (954° C.)/1 hr $H_2$.

Most of the compacted and sintered pieces had a light, but visible, surface oxide. In the first series of tests (TABLE 3) the oxides were not removed from samples fractured from the sintered compacts. Hence, the results included the effect of the surface oxidation. In the second series of tests (TABLE 4), the surface was lightly ground to remove the surface oxides on several samples. Also, the 2350° F. (1288° C.) and 2400° F. (1316° C.) procedure No. 7 samples required cutting as they could not be fractured. (All the samples showed some ductility, but these two did not crack given a 1T bend.) The results (TABLE 4) showed high, variable oxygen/nitrogen results. It is felt that the reported levels are somewhat high due to sample preparation. Thus, for TABLES 3 and 4, the actual oxygen level should not be strictly considered, rather trends in the data should be observed.

Inspection of the data in TABLE 3 illustrate the benefits of pickling the powder prior to compaction. Compacts from pickled powders will have a higher green density, sintered density, lower oxygen level and better edge retention than non-pickled powder compacts. Comparing the procedure No. 6 powder with non-pickled powder shows a 4% improvement in green and sintered density regardless of compaction pressure, and a two- to four-fold reduction in the percent oxygen. The pickling method produces significant improvements. Powders receiving the most processing (procedures 5 or 6) show better results than powders receiving minimal processing (procedures 1 or 2).

Concerning the direct rolled strip, strip prepared from pickled material has an improved tensile strength and ductility relative to the non-pickled powder, strip (TABLE 5). The oxygen level of 90 ppm in the consolidated strip from pickled powder is excellent; however, the nitrogen level may be too high. Strip from this powder has noticeably fewer oxide and/or carbide inclusions and slightly larger grain size (both are finer than ASTM 10) than the non-pickled powder strip.

Treatment of the powders in a boric acid solution prior to consolidation appears to have a dramatic impact in the sintered density when the sintering temperature exceeds 2300° F. (1260° C.) (TABLE 4 and FIG. 2). A density of 95% theoretical was achieved with the procedure No. 7 powders. This compares to an 85–87% density for the powder without the boric acid treatment (procedure Nos. 5 and 6). As before, the extent of pickling apparently has an impact on the effect of the boric acid bath. Powders receiving the most pickling (procedure No. 7) responded much better than powders receiving less pickling (procedure Nos. 3 and 4).

The nitrogen level will vary considerably (50 ppm to 2100 ppm) and may be of some concern. It is postulated that some nitrogen and oxygen pickup occurs during powder drying suggesting the use of vacuum dried powders. Thus, a vacuum drying setup was prepared and powders were pickled according to procedure No. 6 and then vacuum dried prior to consolidation. The powders were compacted at 59.2 ksi (408 MPa), sintered (2200° F. [1204° C.] and 2400° F. [1316° C.]) under hydrogen for four hours and evaluated.

| Sinter Temperature | Run Number | % C | % S | % O | % N |
|---|---|---|---|---|---|
| 2200° F. (1204° C.) | 1 | 0.02 | 0.0006 | 0.08 | 0.012 |
| 2200° F. (1204° C.) | 2 | — | — | 0.09 | 0.020 |
| 2400° F. (1316° C.) | 1 | 0.02 | 0.0008 | 0.07 | 0.016 |
| 2400° F. (1316° C.) | 2 | — | — | 0.05 | 0.010 |

Comparing these results with the data for procedure No. 6 in TABLES 2 and 3 does not show any improvement in the oxygen levels, but nitrogen is at the lower end of the range. Thus, vacuum drying is preferred over air drying.

In conclusion, the instant process includes: (1) an acid bath to rinse to alkaline bath; or (2) an acid bath to rinse to alkaline bath to rinse to acid bath to rinse; or (3) processes 1 or 2 followed by a boric acid rinse. The acid bath is a combination nitric-hydrofluoric which is used commercially for nickel-base alloys and stainless steels. This bath is preferred over straight nitric acid due to improved metal dissolution rates (see Covino et al, "Dissolution Behavior of 304 Stainless Steel in $HNO_3$/HF Mixtures", Metallurgical Transactions A, 17A, Jan. 1986, pp. 137–149). The alkaline bath can be sodium hydroxide, potassium hydroxide, potassium permanganate or combinations of these. It is believed that immersion in one bath may be insufficient for complete oxide removal. Accordingly, a process scheme with additional processing is preferred.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

We claim:

1. A method for treating water atomized powder, the method comprising the steps of:

(a) providing water atomized nickel-base powder;

(b) introducing the powder into a first nitric acid-hydrofluoric acid solution bath;

(c) rinsing the first acid solution from the powder with water;

(d) introducing the rinsed powder into an alkaline solution bath; and (e) rinsing the alkaline solution from the powder.

2. The method according to claim 1 including the additional step of directly rolling the treated powder to a predetermined configuration.

3. The method according to claim 1 wherein a single cycle of steps (a) through (e) completes the treatment process.

4. The method according to claim 1 including:

(f) introducing the powder into a second nitric acid-hydrofluoric acid solution after step (e) of claim 1; and (g) rinsing the second acid solution from the powder with water.

5. The method according to claim 4 wherein a single cycle of steps (a) through (g) completes the treatment process.

6. The method of claim 4 wherein the second acid bath is an aqueous solution of 20% $HNO_3$-2% HF maintained at a temperature between about 72° and 82° C.

7. The method according to claim 1 including the additional step of introducing the treated powder into a boric acid solution to prepare the treated powder for consolidating to a predetermined configuration.

8. The method of claim 7 wherein said boric acid solution comprises an aqueous solution of 5% $H_3BO_4$ maintained at a temperature of about 82° C.

9. The method according to claim 1 wherein the alkaline solution is selected from the group consisting of aqueous solutions of at least one substance from the group of sodium hydroxide, potassium hydroxide and potassium permanganate.

10. The method of claim 1 wherein the first acid bath is an aqueous solution of 20% $HNO_3$-2% HF maintained at a temperature between about 71° and 82° C. and said alkaline solution bath is an aqueous solution of 5% $KMNO_4$-15% NaOH maintained at a temperature of about 82° C.

* * * * *